US005167137A

United States Patent [19]

Barker et al.

[11] Patent Number: 5,167,137

[45] Date of Patent: Dec. 1, 1992

[54] METHOD FOR AUTOMATICALLY ADJUSTING SOLUBLE OIL FLOW RATES TO CONTROL PHYSICAL PROPERTIES OF CONTINUOUSLY ROLLED ROD

[75] Inventors: George W. Barker; Michael G. Crumpler, both of Carroll County, Ga.; James W. Peters, Perry County, Ind.; Delmar R. Hughey, Davies County, Ky.

[73] Assignee: Southwire Company, Carrollton, Ga.

[21] Appl. No.: 551,097

[22] Filed: Jul. 11, 1990

Related U.S. Application Data

[62] Division of Ser. No. 150,216, Jan. 29, 1988, Pat. No. 4,955,216.

[51] Int. Cl.[5] ..... B21B 27/06

[52] U.S. Cl. ..... 72/201

[58] Field of Search ..... 72/10, 13, 200, 201; 164/414, 455

[56] References Cited

U.S. PATENT DOCUMENTS

| | | | |
|---|---|---|---|
| 3,478,808 | 11/1969 | Adams | 164/455 |
| 3,766,763 | 10/1973 | Cofer et al. | 72/201 |
| 4,379,396 | 4/1983 | Hope et al. | 72/201 |
| 4,569,023 | 2/1986 | Wakamiya | 72/201 |
| 4,580,614 | 4/1986 | Haissig | 164/414 |

FOREIGN PATENT DOCUMENTS

| | | | |
|---|---|---|---|
| 0080932 | 6/1983 | European Pat. Off. | 72/201 |
| 0028606 | 2/1982 | Japan | 72/201 |

*Primary Examiner*—Lowell A. Larson
*Assistant Examiner*—Michael J. McKeon
*Attorney, Agent, or Firm*—Stanley L. Tate; James W. Wallis, Jr.; George C. Myers, Jr.

[57] ABSTRACT

A method for automatically adjusting soluble oil flow rates to control physical properties of continuously rolled rod including a nozzle for spraying the rod with fluid, a tank for providing the fluid to the nozzle, a valve means in series with the tank for regulating the fluid flow to the nozzle, a controller means connected to and for controlling the valve to ensure that the fluid flow reaches a desired predetermined rate, a computer means connected to and providing said controller with the desired predetermined fluid flow rate, a flowmeter in series with the valve means for measuring the actual fluid flow rate to the nozzle and providing this information to the controller means so that, if necessary, the valve means may be adjusted to achieve the desired predetermined fluid flow rate and an historical data generating means for automatically adjusting said desired predetermined fluid flow rate in accordance with actual measurements of at least one physical property of the rod whose value depends upon the actual fluid flow rate being measured.

15 Claims, 3 Drawing Sheets

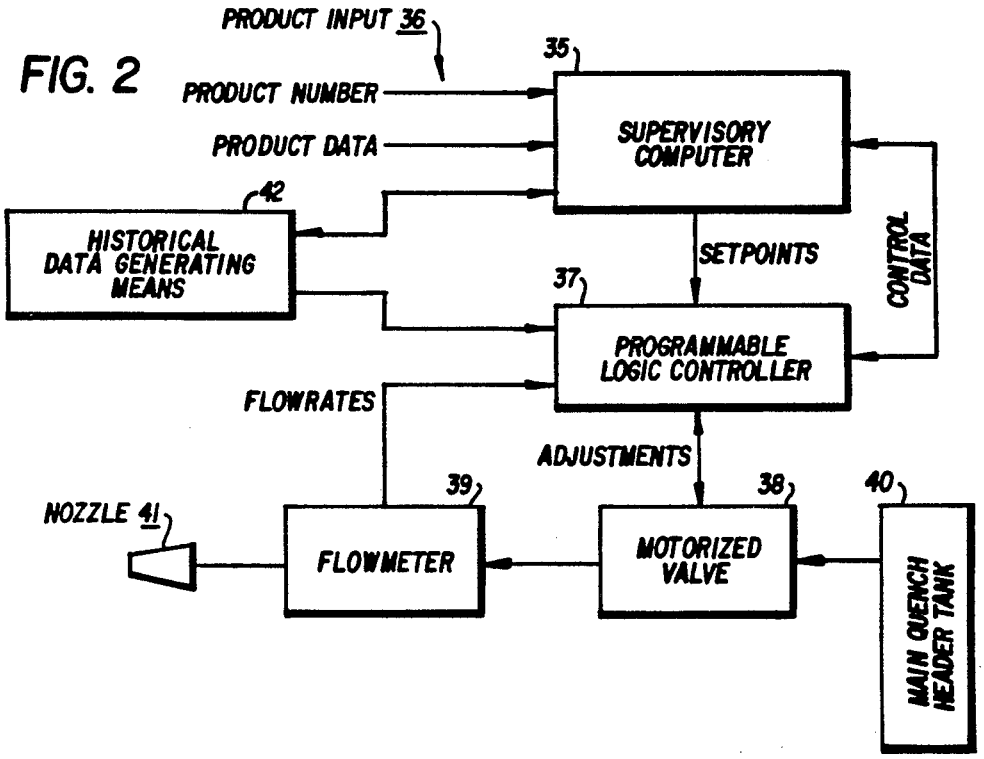
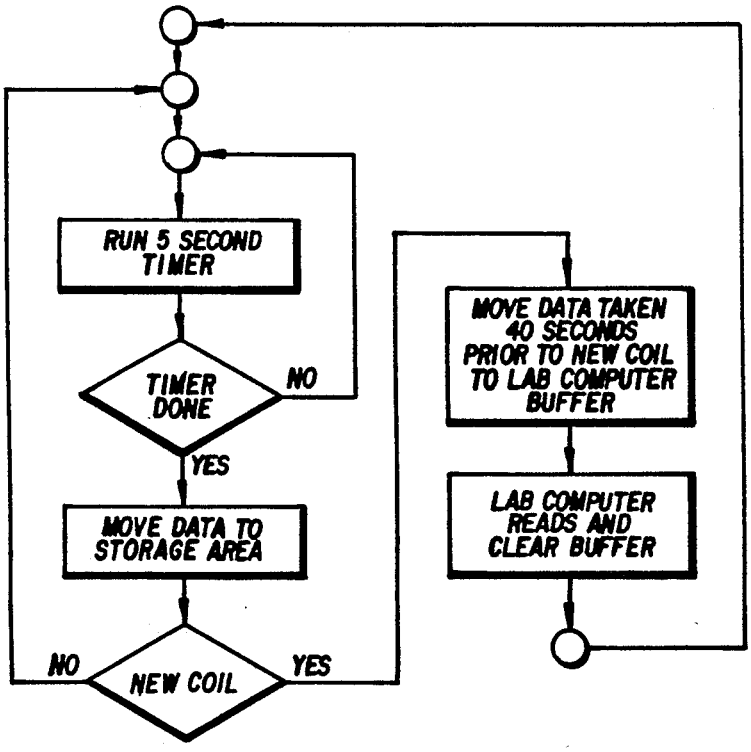
FIG. 3

METHOD FOR AUTOMATICALLY ADJUSTING SOLUBLE OIL FLOW RATES TO CONTROL PHYSICAL PROPERTIES OF CONTINUOUSLY ROLLED ROD

This is a divisional of co-pending application Ser. No. 07/150,216 filed on Jan. 29, 1988, now U.S. Pat. No. 4,955,216.

BACKGROUND OF THE INVENTION

This invention relates generally to the continuous casting and rolling of metal rod, more particularly to an automated fluid cooling and lubricating system for metal rod being rolled down from a continuously cast bar.

In U.S. Pat. No. 3,766,763, entitled CONTINUOUS ROLLED ROD DIRECT COOLING METHOD AND APPARATUS, which is assigned to the assignee of this invention, there is disclosed a cooling and lubricating system for a rolling mill wherein a water-soluble oil solution is provided to cool and lubricate the roll stands of a continuous rolling mill as well as to cool and descale the metal rod being rolled in the mill. The apparatus disclosed in U.S. Pat. No. 3,766,763 included a temperature sensing device located at the downstream end of the rolling mill for constantly monitoring the exit temperature of the rod and flow control valves responsive to the exit temperature for controlling the volume of coolant supplied to the roll stands and rod as it passed through the mill. By controlling the volume of coolant it was possible to optimize the rolling process and produce rod with more consistent metallurgical properties than in prior art processes.

In the process disclosed in the aforementioned U.S. Pat. No. 3,766,763 the flow control valves were manually preset to achieve a predetermined rate of flow consistent with the desired physical properties of the rod being produced, e.g., tensile strength, elongation, and, in the case of electrical conductor (E.C.) rod, conductivity. Since such properties may vary as a function of the cooling rate of the metal during rolling of the rod, it is possible to vary such properties by changing the settings of the flow control valves. This was accomplished manually by the mill operators based on their experience and empirical data. Thus, it was possible to process different metals and alloys, and to produce rod which accommodated the specific specifications of the customer.

In practice, the mill operator monitors the actual fluid flow rate and manually adjusts the settings on the flow control valves to obtain a flow rate that he believes will yield rod having the desired physical properties. The rod is then tested for tensile strength, elongation, conductivity, etc. and the flow control valves are manually re-adjusted if the rod properties are not as desired. This process of trial and error continues until the mill is producing rod having the desired properties.

It should be apparent, however, that it takes substantial time to set the mill up correctly with manual valves since the mill must be running at a production rate in order for the flows to be adjusted correctly by the operator. Another problem has been that a large amount of scrap is generated during the set-up period at the start of a particular production run. Still another problem is that each operator on the multiple shift production line may perceive the correct flow rate differently from another operator, causing the rod produced for a particular customer to have inconsistent physical properties. Thus, the prior art manual process was inefficient and uneconomical.

These and other deficiencies in the prior art process have been overcome, in accordance with this invention, through the use of an automatic control system based on historical data of rod previously produced. This automatic control system is able to adjust the flow control valves during a production run if the rod properties are outside the predetermined tolerance. This ensures that there will be no need to vary flow rates due to the use of different operators. The automatic flow control system is able to respond in the same manner every time, regardless of which operator is monitoring the mill. This will optimize the corrective action and minimize the amount of out-of-tolerance rod being manufactured. Thus, it can be seen that the automatic control system of this invention is much more desirable than the manual valve and pressure gauge implementation used heretofore by multiple operators. The automatic control system will reduce scrap rate, provide quality control, and eliminate mill down time due to malfunction, customer specification or operator error.

Automatic control systems employing a computer, programmable logic controllers, valves and flowmeters have been used to cast and water cool steel. However, such systems do not control or adjust flow rate on the basis of any historical data of the physical properties of the steel manufactured. Such systems also do not use any historical data to effect a change in variables monitored during the production process in order to obtain the desired physical properties of the metal. U.S. Pat. Nos. 4,483,387; 4,006,633; and 3,915,216 are exemplary of such systems. A computer operated system has also been used in the continuous casting of copper bar. In that system, the monitored variables of cast bar temperature and molten metal level in the casting machine are controlled by a computer.

U.S. Pat. No. 4,569,023 discloses a computerized system for controlling the temperature of metal being rolled into rod in a rolling mill. The system includes an arithmetic device for computing and controlling the rate of flow of cooling water based on the rolling schedule of the mill, the expected temperature of the rod at the inlet to the mill, and the target temperature of the rod at the exit of the mill.

In none of the above systems is control based on the desired physical properties of the final rod product and a measurement of actual physical properties of the final rod product.

SUMMARY OF THE INVENTION

The automatic control system of the subject invention is applicable to a number of separate and individual fluid flow loops in the mill. Adjustment of these loops is accomplished by motorized valves, which adjust flow rate, and flowmeters, which measure actual fluid flow rate. A programmable logic controller continuously monitors the actual fluid flow rate provided by each flowmeter and automatically adjusts each valve position to the correct setting, called a set point, in order to obtain the correct fluid flow rate for each loop.

The flow set point is provided to and maintained in a supervisory computer which receives product identification and product quality information. By use of an algorithm in the supervisory computer, flow strategies for each product are maintained so that appropriate rod properties are obtained. Furthermore products may be quickly changed to accommodate each customer's specifications without stopping the mill. Set point adjustments may also be made quickly to correct set points which resulted in the production of rod with undesired properties or to offset process aberrations which may cause a change in the rod properties.

Strategies for a product consist of a list of set points for each product and for each loop in the process to adjust flow rate and thus achieve desired rod properties. The strategies are based on actual customer specifications and/or historical data from prior products or ones in actual production. Historical data can be obtained from an historical data generating means, i.e. physical property measuring equipment, modems, and connecting computer, which monitors plant or laboratory equipment measuring physical properties of interest (i.e. tensile strength, elongation, conductivity, etc.) which are affected by fluid flow rates. For example, a tensile measuring machine will measure the tensile strength of the rod over a period of time and provide that information via modem to a computer for transmission to the supervisory computer as historical data. The algorithm to obtain appropriate flow rates to achieve a certain tensile strength may be saved or adjusted by the supervisory computer for future use based on this historical data. This allows the system to be quickly adapted based on measurements taken on the finished product.

In view of the above, it is an object of this invention to obtain the desired physical properties (i.e., tensile strength, etc.) of a rod that is subjected to a rolling operation and whose physical properties are affected by the rate of fluid flow being used to cool the rod during the process.

Another object of the invention is to reduce the scrap rate which is obtained when the desired physical properties of the rod have not been achieved.

Still another object of the invention is to reduce the set-up time for the mill and therefore increase the production time for the manufacture of rod in the mill.

A further object of the invention is to increase the accuracy of the rolling process being used to manufacture rod so that the physical properties of the rod are uniform throughout the rod.

A more immediate object of the invention is to automatically measure the flow rate which affects at least the physical property of tensile strength of the rod being manufactured.

Another object of the invention is to input historical data into a computer to improve the efficiency and economy of the rolling operation by varying the set points for any loop in the process to obtain the specific tensile strength desired by a particular customer. Thus, different rod with different tensile strengths can be made by simply imposing different set points upon each operation. The uniqueness of the system, therefore, lies in the computer's and/or controller's ability to monitor plural flowmeters and valve positions and change set points to efficiently and economically manufacture rod at specified tensile strengths or other physical properties during every stage of the manufacturing process.

BRIEF DESCRIPTION OF THE DRAWINGS

FIG. 2 is a block diagram of one spray loop or zone of the automatic control system of this invention.

FIG. 3 is a flow diagram schematically illustrating the functions performed by the programmable logic controller.

DETAILED DESCRIPTION OF THE PREFERRED EMBODIMENT

Figure 1:
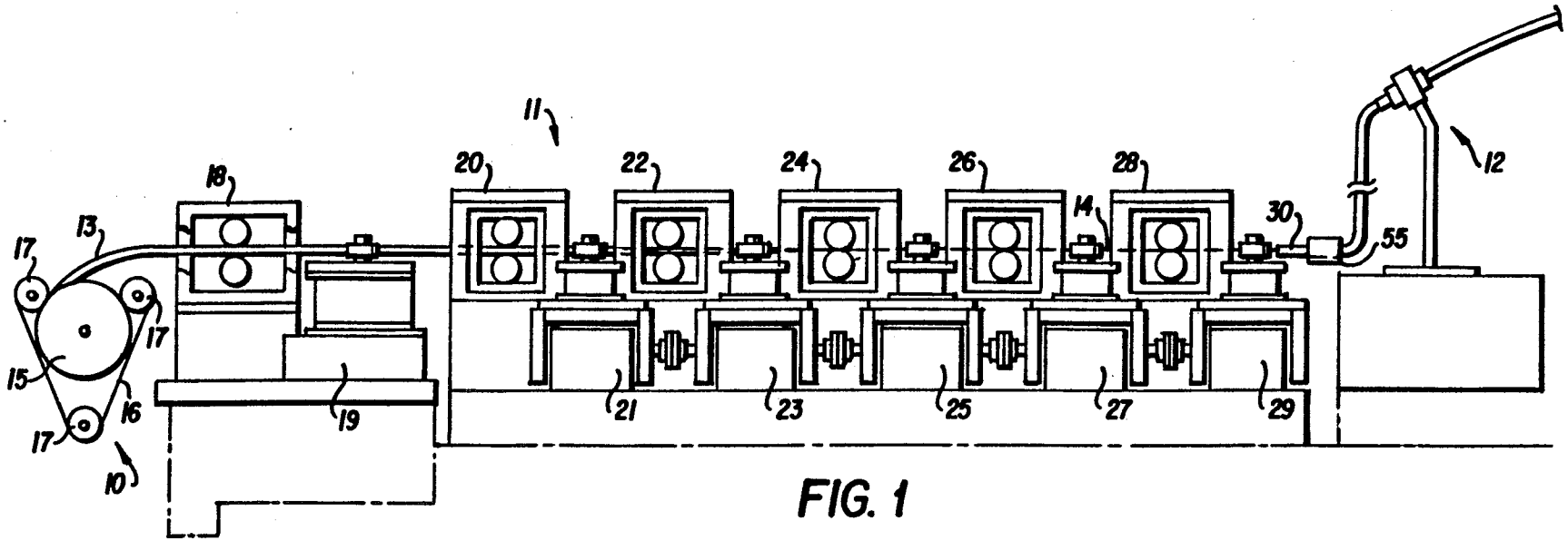
FIG. 1 is a semi-schematic elevation view of rod-manufacturing apparatus including a continuous casting machine, multiple stand rolling mill and pickling apparatus upon which the fluid cooling and lubricating system of this invention is adapt.de to be utilized.

Referring now to the drawings in detail, there is illustrated in FIG. 1 rod manufacturing apparatus including a continuous casting machine 10, a multiple stand rolling mill 11 and pickling or quenching apparatus 12. The continuous casting machine 10 serves as a casting means for solidifying molten metal to provide a cast metal such as a cast bar 13 that is conveyed in substantially that condition in which it solidified from the continuous casting machine 10 to the rolling mill 11. The rolling mill 11 serves as a hot-forming means for hot-forming the cast bar 13 into a rod 14 of aluminum or another hot-formed aluminum-base product in accordance with the method disclosed in commonly assigned U.S. Pat. No. 3,561,105, or a rod of other hot-formed metal such as copper or steel. It should be understood that while the novel system of this invention is particularly adapted to be used with the apparatus for accomplishing the method disclosed in the commonly assigned U.S. Pat. No. 3,561,105 it is not so limited, and in fact, is useful with hot-forming rolling equipment generally.

The continuous casting machine 10 is of conventional casting wheel type similar to that shown in U.S. Pat. No. 3,318,367 and has a casting wheel 15 with a casting groove (not shown) partially closed by an endless band 16 which is supported against the casting wheel 15 by a plurality of idler wheels 17. The casting wheel 15 and endless band 16 cooperate to provide a mold (not shown) into one end of which molten metal is poured to solidify and form, and out of the other end of which emits the cast bar 13 in substantially that condition in which it solidified.

The rolling mill 11 includes a plurality of roll stands 18 through 29 which are arranged in alternate horizontal and vertical dispositions to hot-form the cast metal by a series of successive deformations. The continuous casting machine 10 and the rolling mill 11 are positioned relative to each other so that the cast bar 13 enters the rolling mill 11 substantially immediately after solidification so as to be in substantially that condition in which it solidified and at a hot-forming temperature within the acceptable range of temperatures for hot-forming cast bar 13. No heating of the cast bar 13 is required between the casting machine 10 and the rolling mill 11, but in the event that it is desired to closely control the hot-forming temperature of the cast bar 13, means for adjusting the temperature of the cast bar (not shown) may be placed between the casting machine 10 and the rolling mill 11.

It will be understood that with the apparatus of FIG. 1, the cast bar 13 may be any of a plurality of lengths determined only by the amount of molten metal available and will extend in the form of a cast bar between the continuous casting machine 10 and the rolling mill 11. It should be thus apparent that the steps of solidifying molten metal to obtain cast metal and of hot-forming the cast metal, as well as the step of pickling (i.e., copper or steel) or cooling the hot-formed cast metal in the pickling or quenching apparatus 12, are generally being performed simultaneously once the apparatus of FIG. 1 is in operation.

During the hot-forming of the rod 14 there is employed a water-soluble oil solution for cooling and lubricating purposes. This oil solution is of suitable concentration according to the type rolling mill and the type metal being rolled into rod. In the preferred embodiment disclosed herein, the water-soluble oil solution is supplied to the mill through a plurality of spray nozzles connected to thirty-two spray loops or zones. It should be understood, however, that any number of such loops or zones may be used within the scope of the invention.

In FIG. 2 of the drawings, one of the thirty-two nozzle spray loops in the rolling stage of the rod manufacturing process is shown. A supervisory computer 35 obtains product inputs 36 to initiate the process. Those inputs may be specification details from a customer (e.g., product identification) or similar data (e.g., quality data, i.e., tensile strength, elongation, etc.) used to predict or obtain the desired rod physical properties. The supervisory computer 35 submits to a programmable logic controller 37, set point information in order to obtain the desired physical properties of the rod. If the set point information is not available, such as at the commencement of the manufacturing of a new product, then a trial and error process occurs until initial set point information can be derived from initial production data. This set point information is in the nature of a valve position or fluid flow rate because either is directly related to the physical properties obtained by the rod. The programmable logic controller 37 utilizes the set point information it receives from the supervisory computer 35 to appropriately set the position of a motorized valve 38 to obtain the appropriate flow rate and hence physical properties of the rod. The motorized valve 38 contains a reversible motor and motor actuated valve. The programmable logic controller 37 receives as a continuous input the position of the motorized valve 38 and actual flow rate information from a flowmeter 39. Thus, the programmable logic controller 37 is knowledgeable, as is the supervisory computer 35, of the desired and actual flow rates for each of the thirty-two loops in the rolling stage of the rod manufacturing process. If the desired flow rate and the actual flow rate are different, then the programmable logic controller 37 adjusts the motorized valve 38 accordingly to obtain the appropriate flow rate. The motorized valve 38 and flowmeter 39 are both located in the stream of soluble oil being pumped from a main quench header tank 40 to a nozzle 41 for spraying of soluble oil on the rod.

When the production of a predetermined length (coil) of rod is completed (taking anywhere from two to ten minutes), a sample of the rod is immediately tested to determine its physical properties. Values corresponding to a particular physical property, e.g., tensile strength, and values corresponding to actual flow rates monitored by the programmable logic controller 37 during the run are then processed by the supervisory computer 35 to determine whether the actual physical property of the rod is within the preset tolerance for the physical property which was input into the supervisory computer 35 at the initiation of the process. If the rod is out of tolerance, the supervisory computer 35, in cooperation with an historical data generating means 42, will calculate a new set point for the programmable logic controller 37 that is expected to bring the physical property into tolerance.

In calculating the new set point the supervisory computer 35 performs an off-line simulation to determine whether certain changes in the flow rate will bring the desired physical property into tolerance. This is accomplished by analyzing the effect of certain incremental changes in the flow rate (either positive or negative) for one or more predetermined cooling loops or zones. Each incremental change is analyzed and compared with historical data stored in the historical data generating means 42 to determine whether the incremental change will result in the desired physical property being in tolerance. If it is not, the next incremental change is analyzed and compared until predetermined limits for the loop or zone under analysis are reached. At that point, the supervisory computer 35 undertakes an analysis of the next loop or zone that it has been programmed to consider, and so on. When the historical data generating means 42 determines that a calculated flow rate will bring the desired physical property into tolerance, then and only then will a signal be sent to the programmable logic controller 37 to change the realtime set point. Thereupon, during production of the next coil of rod, the programmable logic controller 37 will monitor the actual flow rates and, as previously described, control the motorized valves 38 to bring the flow rates into conformance with the new set points.

The foregoing process of rod testing, comparison with historical data, and determination of new set points, if necessary, may be repeated for each coil of rod produced, or at any other predetermined interval, such as after each heat of metal processed. The supervisory computer 35, of course, will not change the set points until new data is entered from the historical data generating means 42.

The supervisory computer 35 is programmed so that it will analyze the effect of given incremental changes in the flow rates of the cooling loops or zones that are expected, based on operating experience, to have the greatest effect on the particular metal being processed. Thus, for example, if the supervisory computer 35 is programmed to analyze four loops, the analytical sequence is arranged in order of priority with the loop most likely to have the greatest effect analyzed first. The particular loops to be analyzed, their number and order of sequence in the program may be varied depending on the particular metal being processed.

The historical data generating means 42 may comprise a direct modem or network hookup and laboratory equipment enabling the laboratory equipment to communicate with the controller means 37 or may include a separate computer or computers which receive the laboratory generated information from operators of the laboratory equipment. These computers would then communicate the laboratory generated information by modem or network output line to controller 37 and then to the supervisory computer 35.

The following variables in the rolling stage are monitored and displayed by the supervisory computer: rod, cast bar, solution, water, and lube oil temperatures; rolling mill motor and extractor pinch roll speeds; soluble oil flow; production rate; and drive motor currents. One or more of these variables can affect the physical properties of the rod during rolling. The supervisory computer 35 can produce a change in value of these variables if the desired physical properties of the rod are not achieved as indicated by the information generated by the historical data generating means 42.

Although the preferred embodiment shown in FIG. 2 includes the programmable logic controller 37, it is within the level of skill in the art after having knowledge of the invention disclosed herein to omit such a controller from the control system and connect the supervisory computer 35 directly to the motorized valve 38 in order to position the valve correctly. In this alternative scheme, all inputs and outputs of the controller 37 would be inputs and outputs to the supervisory computer 35. The reason the programmable logic controller 37 is included in the preferred embodiment is that it contains many more ports than does a supervisory computer and therefore facilitates connection with multiple input/output devices transmitting needed information through the system.

It is also within the level of skill in the art after having knowledge of the invention disclosed herein to combine the flowmeter and motorized valve functions into a single unit. It will also be appreciated that each of or a group of the thirty-two loops in the rolling stage may require different flow rates to achieve precision quality control of the physical properties of the rod. The supervisory computer 35 and programmable logic controller 37 can provide different set points to a number of motorized valves by virtue of the memory contained in each of those units. The supervisory computer 35 can determine, by analysis of the information received from the historical data generating means 42, which of the thirty-two loops should have its set point or flow rate changed and which, if any, of the monitored variables should have its value changed in order to achieve precision quality control of the physical properties of the rod. Thus, the supervisory computer 35 and programmable logic controller 37 can act as centralized units controlling the operation of a number of different loops with different set points and variables with different values to obtain the desired physical properties of the rod manufactured per the above process.

The method of setting the position of the motorized valve 38 may vary also. The feedback loop between motorized valve 38, flowmeter 39, and programmable logic controller 37 may be null seeking, i.e., when the actual parameter and desired parameter are compared and if the difference is not zero an error signal is produced to effect variation of the actual parameter until the difference between the two reaches zero, or may contain positive or negative feedback to reach the appropriate valve position without needless oscillation. Alternatively, the valve position may be directly set by the controller 37 without concern for positive, negative, or null seeking feedback.

Figure 4:
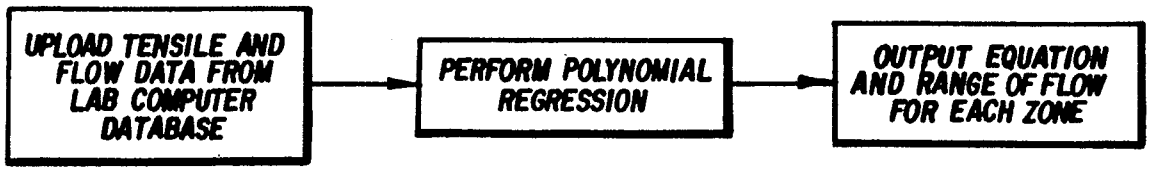
FIG. 4 is a flow diagram schematically illustrating the functions performed by the historical data generator.
Figure 5:
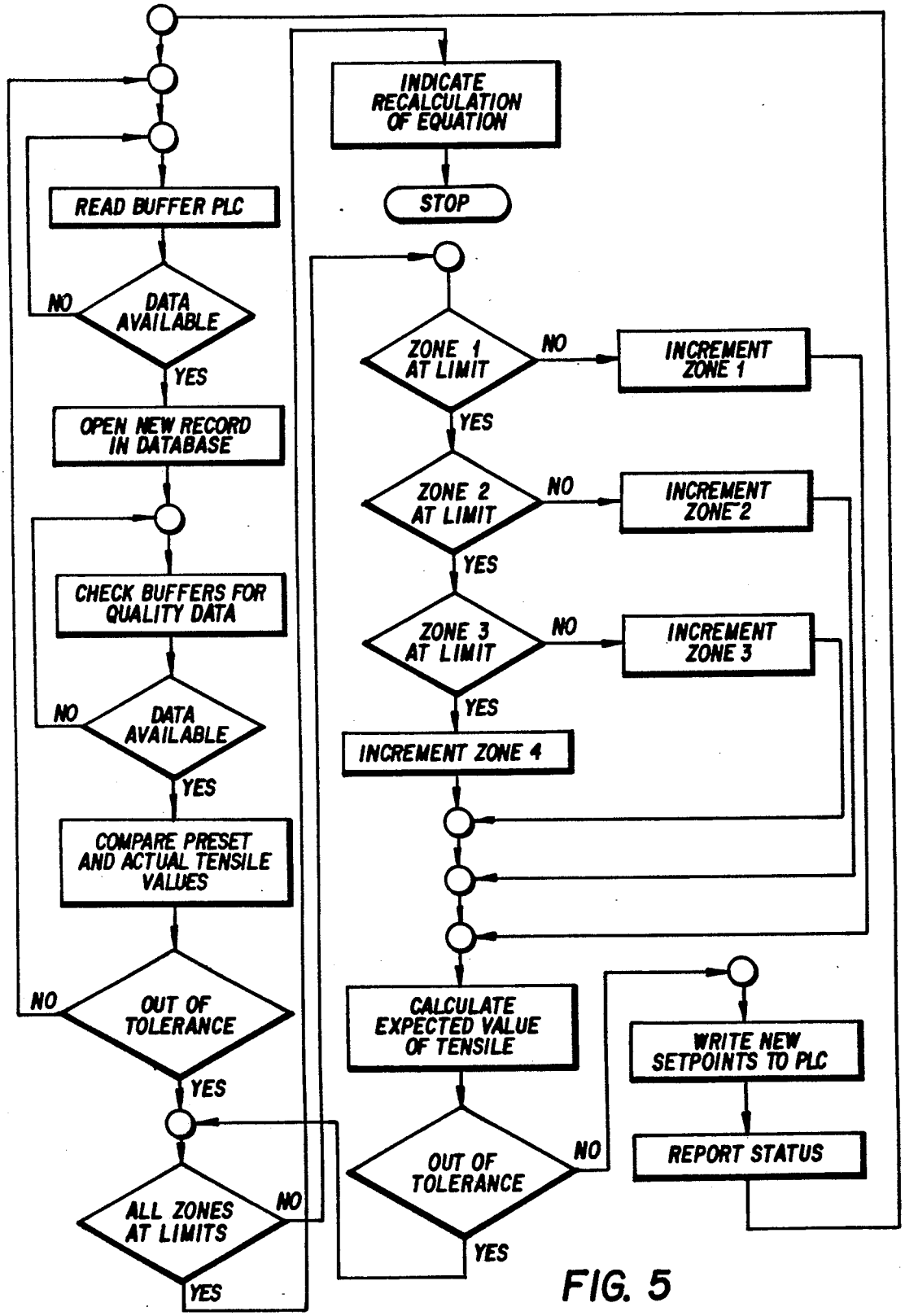
FIG. 5 is a flow diagram schematically illustrating the functions performed by the supervisory computer.

Referring now to FIGS. 3, 4, and 5, there are illustrated flow diagrams for the programmable logic controller 37, the historical data generating means 42, and the supervisory computer 35 relating to one exemplary system involving measurement and control of rod tensile strength. The steps performed by the programmable logic controller 37 in carrying out its data collection function are shown in FIG. 3 as follows:

A. Initial data collection is made by the programmable logic controller at 5 second intervals, and stored in a file.
   1. Data is defined as the actual flow of a particular flow loop.
   2. Supervisory Computer setpoint controlled Flow loops have been preselected based on past experience of operators at trimming the rod mill flows to adjust rod tensile strength.
   3. Supervisory Computer setpoint controlled Flow Loops are the 4 Flow Loops most often used to trim the rod tensile strength.

B. Run timer beginning at the start of each new rod coil, and continuing until rod coil is complete.

C. Move data values stored 40 seconds before end of rod coil to Supervisory Computer read buffer area.

D. Supervisory Computer reads data and stores it, associated with stock and rod coil serial number.

E. Coil sample is analyzed in lab, and quality data including rod tensile strength, is placed into database located in the File Server with associated flow data from the programmable logic controller (in (D). above).

The steps carried out by the historical data generating means 22 in performing its data analysis function are shown in FIG. 4 as follows:

A. Data analysis is performed upon request by the Historical Data Generator having access to the database stored in the File Server, so as not to interfere with continuing data collection.
   1. Data analysis is based upon stock number.
   2. Request for a certain stock number to be analyzed is made by the Historical Data Generator operator.

B. The analysis program uploads database information from the File server as follows:
   1. Tensile strength for each rod coil serial number;
   2. Supervisory Computer setpoint controlled Flow Loop number, and flow data for each rod coil serial number.

C. A seventh order multivariate polynomial regression is made on the data from (b).
   1. The dependent variable is rod coil sample tensile strength.
   2. The independent variables are the flows.

D. The generated equation is of the form:

$$
\begin{aligned}
t(f_0 \ldots f_z) = {} & a_0 + a_1 f_0 + a_2 f_0^2 + a_3 f_0^3 + \ldots \\
& + a_7 f_0^7 + b_1 f_1 + b_2 f_1^2 + b_3 f_1^3 + \ldots \\
& + b_7 f_1^7 + c_1 f_2 + c_2 f_2^2 + c_3 f_2^3 + \ldots + c_7 f_2^7 + \ldots \\
& + z_1 f_z + z_2 f_z^2 + z_3 f_z^3 + \ldots + z_7 f_z^7
\end{aligned}
$$

E. The equation is then printed, along with the maximum range of flow experienced by each Flow Loop.

After the foregoing equation is determined, the system operator then performs the following steps:

A. The setpoint equation and the Flow Loop maximum ranges are reviewed by the operator.
   1. The operator checks to see that the Flow Loop maximum ranges are reasonable.
   2. The operator substitutes flow information into the equation to insure that reasonable results are obtained.

B. If a problem is found, then the database information is reviewed, and problem records are deleted before recalculating the equation.

C. The equation is then loaded by stock number into the Supervisory Computer for realtime setpoint control.

D. The operator also loads the maximum allowable control ranges for each Flow Loop, as well as the Flow Loop priority (i.e., the order in which to change the Flow Loop setpoints).

The steps performed by the supervisory computer 35 in controlling the setpoints as shown in FIG. 5 are as follows:

A. The Supervisory Computer checks to see if a newly entered rod coil sample tensile strength value is within tolerance.

B. If it is not, the Supervisory Computer calculates the error which is the difference between the desired value of rod coil sample tensile strength and the actual value.

C. The Supervisory Computer then checks to see if all zones are at their control limits, and aborts if they are (see (J)).

D. If not (C), and the error is positive, a positive increment is selected to calculate the new setpoint for the controlled zones.

E. If not (C), and the error is negative, a negative increment is selected to calculate the new setpoint for the controlled zones.

F. The Supervisory Computer increments the highest priority Flow Loop setpoint by 1 gpm and recalculates the expected value of rod coil sample tensile strength.

G. If the expected value is not within tolerance, the error is recalculated by subtracting the actual value from the expected value.

H. Step (F) is repeated until the zone reaches the maximum allowable control range, or the expected value of rod coil sample tensile strength is within tolerance.

I. If the highest priority zone reaches the maximum allowable control range, the zone with the next highest priority is selected.

J. If all control zones reach their respective maximum allowable control ranges, and the expected value of rod coil sample tensile strength is still not within tolerance, then no more adjustments are made until the operator resets the automatic operation.

K. If the expected value of rod coil sample tensile strength is within tolerance, and all zones are not at their maximum control limits, the realtime zone setpoints are incremented by the calculated amounts, and no more adjustments are made until another rod coil sample tensile value is entered.

The preferred embodiment above describes exemplary structure for performing specific tasks in the rod milling process. In practice, it has been found that a Texas Industrial Microsystems IPC 2000 series computer is sufficient to perform the tasks of the supervisory computer 35. The IPC 2000 is a rugged mounted computer designed for industrial process control and factory automation. It has 8 full size personal computer compatible expansion slots for input/output, a system board 640K memory, and an Intel 8088/8087 processor. It has also been found that an Allen-Bradley PLC-2/30 programmable logic controller is sufficient to perform the tasks of the programmable logic controller 37. During program operation, the PLC-2/30 programmable logic controller, through its processor, continuously monitors the status of input devices and, based on user program instructions, either energizes or de-energizes output devices such as electrically actuated valves. Because the memory is programmable in the PLC-2/30, the user program can be readily changed if required by the application. The PLC-2/30 programmable logic controller has a memory capacity of 16,256 words and an 896 input/output device capacity.

It has also been found that a suitable motorized valve 38 is a Worcester Controls electronic control valve which is comprised of a Worcester 73/75 actuator, which is coupled to a valve stem and has the power to open, close, or throttle the valve, and an AF-17 autoflow electric positioner, which receives a message from a controller and interprets and transmits that message to the actuator to correct its position. A suitable flowmeter is a Fisher & Porter Mini-MAG magnetic flowmeter whose meter body is a sealed section that bolts between the manufacturer's pipeline flanges. The measuring electrodes that contact the process fluid have their ends flush with the inside of the liner which is turned out against the flange faces. A signal connector may also be used with the flowmeter to transmit the metered signal to a computer or controller.

While various modifications may be suggested by those skilled in the art, it should be understood that all such modifications as reasonably and properly come within the scope of the invention disclosed herein are within the protection afforded by this patent.

What is claimed is:

1. A method of automatically controlling at least one metallurgical property of metal rod being rolled in a continuous rolling mill having plural rolling stands including a first and last roll stand, the metallurgical property being a function of the flow rate of coolant applied to the rod as it passes through the mill, comprising the steps of:

(a) selecting a predetermined flow rate of coolant applied to the rod in selected rolling stands expected to produce a rod having a desired metallurgical property within a certain tolerance;

(b) periodically testing the rod to determine whether the measured metallurgical property is out of tolerance;

(c) automatically adjusting the predetermined flow rate, if necessary, to bring the measured metallurgical property into tolerance, wherein the step of automatically adjusting the predetermined flow rate includes:

(i) generating, according to a predetermined product specification an equation that is a function of at least one rod metallurgical property which is related to the actual flow rate and the measured metallurgical property;

(ii) calculating the effect of a series of incremental changes in the flow rate on the metallurgical property according to the equation; and (iii) determining the minimum number of said incremental changes necessary to bring the metallurgical property into tolerance;

(d) continuously monitoring the actual flow rate of the coolant;

(e) determining whether the actual flow rate deviates from the predetermined flow rate;

(f) correcting any deviation in the actual flow

2. The method of claim 1, further including the step of providing a data base for storing historical data pertaining to the effect of given flow rates on the metallurgical property, and wherein the step of calculating the effect of a series of incremental changes in the flow rate includes comparing the calculated flow rates with the data in said data base.

3. The method of claim 1, wherein said calculating step is performed in a computer off-line of the rolling mill.

4. The method of claim 1, further including the step of providing a product specification which includes the desired metallurgical properties as a function of the flow rate of the coolant.

5. The method of claim 1, wherein said metallurgical property is tensile strength.

6. The method of claim 1, wherein said metallurgical property is elongation.

7. The method of claim 1, wherein said metallurgical property is conductivity.

8. The method of claim 1, wherein the rod is accumulated in coils and the rod testing rate is about one measurement per coil.

9. The method of claim 1, wherein flow rate is controllable in at least one roll stand.

10. The method of claim 1, wherein flow rate is controlled in the first roll stand of the rolling mill.

11. The method of claim 9, wherein flow rate is controlled in the last roll stand of the rolling mill.

12. The method of claim 1, wherein flow rate is controlled in the roll stands having the most significant effect on the desired rod metallurgical property.

13. The method of claim 1, wherein each roll stand of the rolling mill includes a separate flow rate control loop and wherein each loop is separately adjustable, the step of adjusting some of the loops independently of others.

14. The method of claim 13, further including the step of prioritizing the order in which the loops are adjusted.

15. The method of claim 13, wherein the flow rate through each stand is adjustable in increments of about 1 gallon per minute.

* * * * *